US007192219B2

(12) United States Patent
Graziosi

(10) Patent No.: US 7,192,219 B2
(45) Date of Patent: Mar. 20, 2007

(54) PIER BOOT AND METHOD FOR SEALING A CRAWLSPACE

(76) Inventor: Dominick Graziosi, 4212 Whitehall Rd., Sandy Hook, VA (US) 23153

( * ) Notice: Subject to any disclaimer, the term of this patent is extended or adjusted under 35 U.S.C. 154(b) by 0 days.

(21) Appl. No.: 11/373,346

(22) Filed: Mar. 10, 2006

(65) Prior Publication Data

US 2006/0216119 A1 Sep. 28, 2006

Related U.S. Application Data

(60) Provisional application No. 60/663,996, filed on Mar. 22, 2005.

(51) Int. Cl.
*E02D 31/02* (2006.01)

(52) U.S. Cl. ..... 405/229

(58) Field of Classification Search ..... 405/229, 405/231

See application file for complete search history.

(56) References Cited

U.S. PATENT DOCUMENTS 4,603,517 A * 8/1986 Lyons, Jr. ..... 52/60
6,223,463 B1 * 5/2001 Carlson et al. ..... 52/101
6,280,120 B1 * 8/2001 Okamoto et al. ..... 405/232

OTHER PUBLICATIONS

Building A Sealed Crawlspace, JLC, Oct. 2003, nine pages.

* cited by examiner

*Primary Examiner*—Frederick L. Lagman
(74) *Attorney, Agent, or Firm*—John H. Thomas, P.C.

(57) ABSTRACT

A pier boot is fabricated for installation around a pier in the crawlspace of a building. The pier boot includes a substantially impermeable polymer sheet. The polymer sheet has a flange portion and two or more slits therein. The slits define flap portions of the polymer sheet, and the slits each have an end that defines a hinge in the polymer sheet. The pier boot is installed around a pier in order to optimize the seal around that pier when constructing a conditioned crawlspace.

8 Claims, 2 Drawing Sheets

PIER BOOT AND METHOD FOR SEALING A CRAWLSPACE

This application claims the benefit of U.S. Provisional Application No. 60/663,996, filed Mar. 22, 2005.

The present invention is directed to a pier boot and to its use in helping to seal a crawlspace of a home or other building. The pier boot is a polymer sheet having slits therein that is adapted to be fitted tightly around a pier when building a new home or building. By mounting the pier boot around the pier, the crawlspace enjoys a better seal and advantages related thereto.

BACKGROUND OF THE INVENTION

Crawlspaces under buildings have a natural tendency to be damp or wet. These conditions may often lead to a number of undesired problems. These problems may include premature failure of house main support beams, premature failure of floor joists; failure of floor joist insulation as a result of water saturation; rapid mold growth (and since most homes have some portion, if not most of the HVA system in the crawlspace, the mold has an opportunity to become airborne in the home); insect and rodent infestation; and severe cupping and warping of hardwood flooring.

Conventionally, crawlspaces are vented. The premise of a vented crawlspace is that outside air will circulate in the crawlspace and have a drying effect. Because a crawlspace is subject to outdoor temperatures, insulation is typically installed in the floor joist not only to insulate the home, but also to help protect exposed plumbing. Conventionally, a layer of polyethylene film or other plastic (collectively "poly" or "poly film") is laid on the floor of the crawlspace. While local codes may vary, the poly coverage typically can range from 80 percent to 90 percent, but is rarely if at all 100 percent.

Large amounts of water and/or moisture may accumulate in conventional vented crawlspaces for at least two reasons: varying outdoor conditions and ground water. When outdoor conditions are moderate, mild temperatures with low humidity, drying can in fact occur in a crawlspace. The problem comes when the ambient air is hot with moderate to high humidity levels. When this hot/humid air circulates into a crawlspace, where it is considerably cooler, the moisture in the "fresh" air will condense. Just as dew can be seen on grass in the mornings, it is possible to see dew in a crawlspace. In extreme cases, the dew may actually drip and run from saturated floor joists and insulation. With respect to ground water, even though drain tile may be installed around a crawlspace perimeter, it is still possible for moisture from the ground to evaporate into the crawlspace, because the poly film on the ground may have numerous gaps in it. In many cases, water may actually be running onto the floor of the crawlspace as a result of the dew collected on the floor joist, insulation and main beams.

A more modern approach to crawlspace management is referred to as a "conditioned" crawlspace. The premise of a conditioned crawlspace is that the air that circulates in the crawlspace will come from the "conditioned" (heated and cooled) air inside the home. Since the crawlspace is not exposed to outdoor conditions (no exterior vents in a conditioned crawl) and it is both heated and cooled to some degree, it is necessary to insulate the exterior walls of the foundation instead of between of the floor joist. The floor of the crawlspace must be covered with poly film substantially 100 percent. In order to be effective, the plastic must completely seal the crawlspace from any ground water. While utilizing a conditioned crawlspace has some ancillary benefits such as energy savings, it is clear that the main purpose of a conditioned crawlspace is to directly address the moisture and resulting problems inherent to a vented crawlspace.

While conditioned crawlspaces are excellent in theory, there is at least one major obstacle that prevents the overwhelming use of the system—it is practically impossible to achieve a 100 percent seal of the crawlspace using products presently available. While it is relatively easy to seal a floor plastic at the flat portions of the wall of a crawlspace, sealing the plastic at a building pier presents difficulty. The current practice is to cut the plastic sheets of flooring to precisely fit a pier. Some type of sealer is then used to achieve, as close as possible, a 100 percent seal. While this is hypothetically effective, it is practically difficult to achieve in the field. A comparison of doing this would be to gift wrap a package so that the comers and seams were all perfectly aligned and tight, the only catch being that you would have to make all the cuts and folds before placing a box inside the wrapping.

SUMMARY OF THE INVENTION

Accordingly, it is an object of the present invention to overcome the foregoing problems and to provide a pier boot construction to enable a superior seal to be formed around a pier of a building.

In one example, a pier boot for installation around a pier in the crawlspace of a building includes a substantially impermeable polymer sheet. The polymer sheet includes a flange portion and a plurality of slits therein. The slits define flap portions of the polymer sheet, and the slits each have an end that defines a hinge in the polymer sheet. The slits may include two intersecting slits in the polymer sheet. The slits may be substantially straight lines that intersect approximately at mid points in a length of the two slits, whereby the two slits form an "x" in the polymer sheet. The slits may be contained completely within the polymer sheet or one or more of the slits may be open on one end to the side of the polymer sheet. The hinge shape may be round.

In another example, a method of creating a vapor barrier around a building pier comprises the steps of providing a pier and providing a pier boot to fit around the pier. The pier boot includes a substantially impermeable polymer sheet which comprises a flange portion and a plurality of slits therein. The slits define flap portions of the polymer sheet and the slits each have an end that defines a hinge in the polymer sheet. The pier boot is then mounted around the pier wherein the flaps rest against a side of the pier. Adhesive is then applied to the flaps and/or the pier, thereby sealing the flaps to the pier.

DETAILED DESCRIPTION

The present invention is directed to a pier boot and a method for using the pier boot in order to assist in the creation of a sealed crawlspace. The pier boot will be discussed in connection with several examples; however, it is presumed that one of skill in the art would be able to construct variations of the same or similar pier boot. It is believed that these variations are encompassed by the teachings and claims herein.

In the construction of a home or other building, a pier is the general term for any type of sub-support, used in addition to the foundation, to carry the load of the structure. Piers are vital in construction as they shorten the span of the main support beams. In the case of home construction, piers can be free standing in the center of a crawlspace and/or attached to the exterior foundation walls. The piers are conventionally constructed on concrete footings. The typical composition of a pier is cinder block and mortar, square or rectangular in shape. Piers, however, could come in many other shapes including, for instance, round, oval, triangular, elliptical, etc. The composition of a pier may also vary from, for instance, metal to concrete to brick to wood to any other material that may be selected by a designing engineer.

Piers not only come in different shapes and sizes, their quantity and placement in a home may vary. Every pier that is in the same size and same shape family may be different. For example, a home may have many 12"×12" square piers. The piers will often be different heights, and will always have their own unique characteristics including the amount of mortar protruding from the joints of the individual blocks, defects and chips in the individual blocks, and the acceptable variation in the alignment of the individual blocks. The only method now available to seal around a pier is to bunch several sheets of poly film around the pier. This method is typically ineffective and unsightly. Even a combination of glues, tapes, and mastic duct sealer cannot provide a consistent, labor efficient seal.

A properly designed and installed, one-piece pier boot solves the problem of the bunching of poly film around a pier. By utilizing a one-piece pier boot, the plastic film does not have to be cut to unreasonable tight tolerances. With a pier boot, the plastic film mounted beneath a building only needs to be cut to within the tolerance of the flanged portion of the pier boot. The problems arising from the individual finger print of each pier are also solved as a one-piece pier boot may fit and positively seal any pier in its size and shape family, regardless of variations found in the field.

Figure 1:
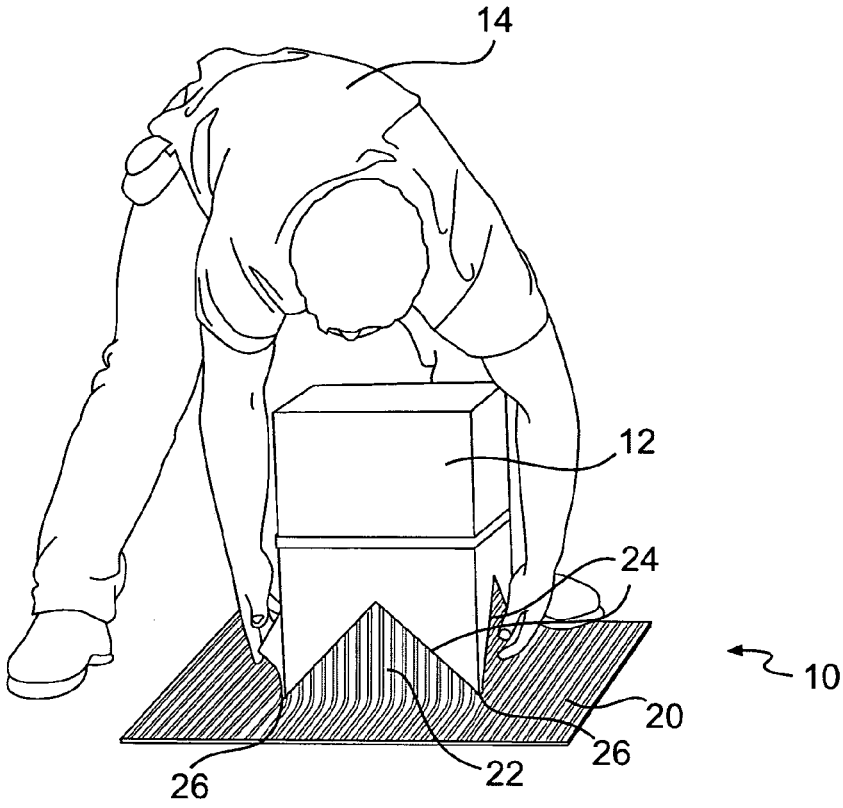
FIG. 1 is a perspective view of a pier boot in accordance with the present invention in the process of being mounted about a pier.
Figure 3:
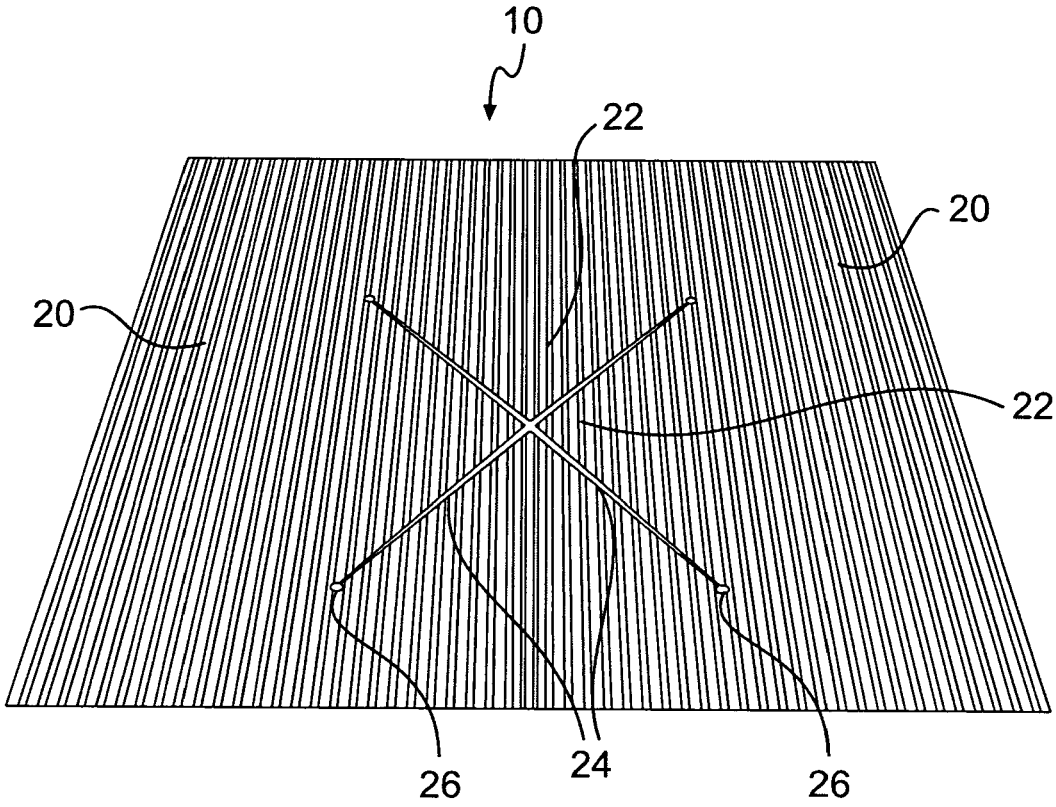
FIG. 3 is a perspective view of the pier boot shown in FIG. 1.

Referring first to FIGS. 1 and 3, a pier boot 10 is made of a substantially impermeable polymer sheet. The pier boot 10 includes a flange portion 20 and flaps 22. The flaps are defined by slits 24 in the middle of the boot 10. In the embodiment shown in FIGS. 1 and 3, the slits 24 form an "x" in the center of the pier boot 10. At the end of each slit 24 there is a round hinge 26. As shown especially in FIG. 1, once installed, the flange 20 of the boot 10 will rest generally flat on the ground while the flaps 22 will rest against the side of a building pier 12. The hinges 26 are formed in the boot 10 to reduce or eliminate the likelihood that the plastic pier boot will rip or tear. In this example, the slits 24 are contained completely within the pier boot 10.

Figure 2:
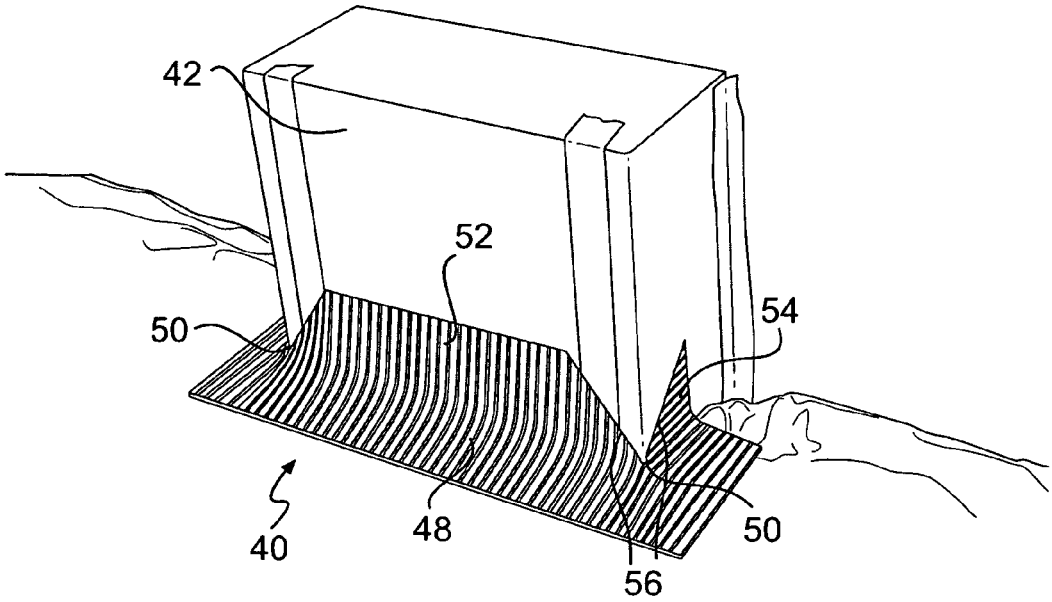
FIG. 2 is a perspective view of an alternative embodiment of a pier boot in accordance with the present invention.
Figure 4:
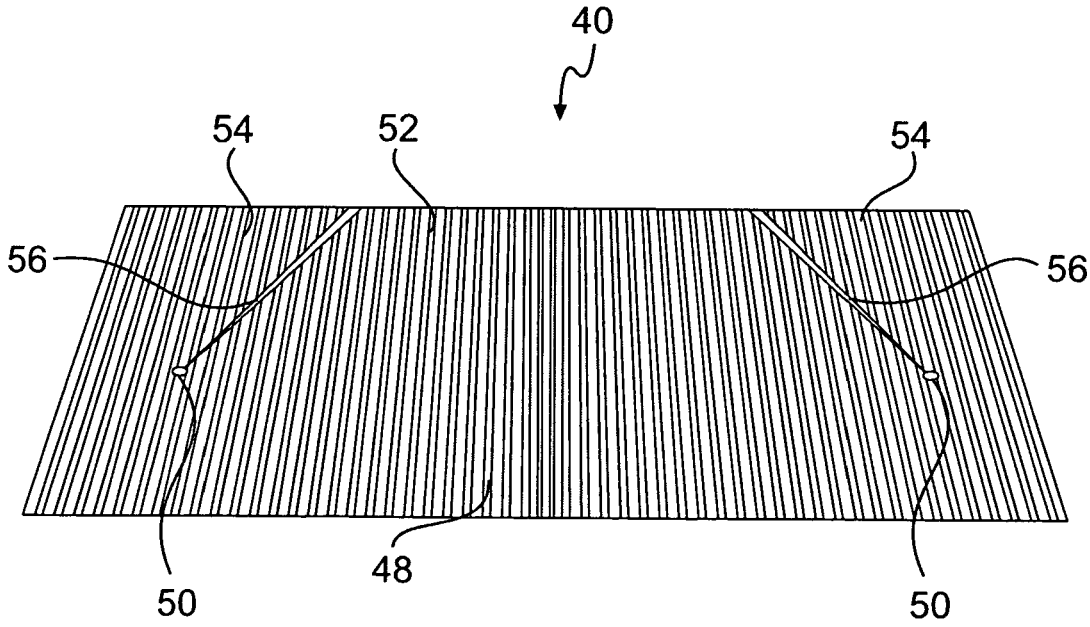
FIG. 4 is a perspective view of the pier boot shown in FIG. 2.

FIGS. 2 and 4 illustrate a further embodiment of a pier boot 40. The pier boot 40 is made of a substantially impermeable polymer sheet. The pier boot 40 includes a flange 48 and flap portions 52 and 54. The flap portions 52 and 54 are defined by the slits 56. The slits 56 are open on one end to a side of the pier boot 40. The other end of the slits 56 includes hinges 50. In this example of FIGS. 2 and 4, the pier boot 40 is adapted to be mounted around and seal a pier 42 that is attached to or forms a part of the exterior foundation wall of a structure. For this reason, the pier boot 40 does not wrap entirely around the pier 42. It merely wraps around the portion of the pier 42 that would be exposed to the crawlspace of the building.

In general, a flange is important to the performance of a pier boot. A flange not only enables a maximum pier opening tolerance in the poly film that is possible to achieve repeatability in the field, the flange also eliminates the numerous film to film seams found currently at piers. The flange is the portion of the pier boot that will be permanently sealed to the floor poly film. The shape defined by the flange portion of the pier boots 10 and 40 is square. The shape, however, could vary based on installation needs or on the shape or composition of the material used to manufacture a pier boot. The shape of a pier being sealed could also affect the desired shape of a flange. For example, a triangular pier may preferably be used with a triangular, square or round flange. The size of a flange is directly proportional to the pier opening tolerance of the floor poly film. In one example, a pier boot has an overall flange size of 27"×27" which leaves 7.5 inches of flange on each side of a pier that is 12"×12". Thus, in one example of a pier boot, the opening tolerance of the polymer sheet is 27"×27" with no more than 7.5" on any one side. The flange side of this example pier boot allows for rapid installation of floor poly film, but the flange size could be increased or decreased based on manufacturing or installation needs.

The boot opening defined by the slits in a pier boot is important to the performance of a pier boot. The boot opening is what allows a one-piece pier boot to be installed on a pier. The shape of the opening must coincide with the shape of the pier it is used on. A square pier requires a square opening, while a rectangular pier requires a rectangular opening, while a circular pier requires a round opening, etc. The shape of the opening that mirrors a pier is what allows the pier boot to fit snugly around the pier, thus aiding in the sealing around the pier. Similarly, the size of the boot opening, measured from the center of adjacent hinges, should coincide with the actual dimension of the pier that it is to be used on. In an example boot, the opening dimension, measured from center of one hinge to the next on the same side is about 11.5", because the actual measurement of a 12" support pier that it is intended to seal is 11.5". Like the shape, the boot opening size is intended to mirror the dimension of a pier that is being sealed.

The pier flap is likewise important to the performance of a pier boot. The flap is the portion of the boot that enables a positive seal of the boot to the pier. The portion of the boot that opens up as the boot is installed and is perpendicular to the flange. The flap is the portion of the boot that will be permanently sealed to the pier. In the examples of the pier boot shown in the drawings, the flap shape is generally triangular. The triangular shape is chosen, because it is easy to consistently manufacture. The flap shape could be changed if it were advantageous from a manufacturing standpoint without compromising the ability of a boot to seal a pier. Flap size will vary from boot to boot depending on all of the other dimensions of the boot and the manufacturing process of the boot.

The hinge is important to the performance of a boot. The hinge is an opening in the boot that allows the flap to open without damaging or tearing the flange. The hinge allows an installer to open the flaps beyond perpendicular so that a sealer may be applied to the flange or to the pier for sealing. The hinge is also what allows the boot to mold itself to each unique pier. On boots for pier shapes that have corners, the hinges are placed in the corners of the boot opening. On boots for pier shapes without corners, the hinges may be placed at regular intervals around the perimeter of a boot opening. The hinge shape in the examples shown in the drawings is round. This shape is chosen for ease of manufacturing; however, other hinge shapes may be used. Hinge shapes that do not have corners are preferable, since they are the most effective for allowing the flaps to open while preventing tearing or distorting of the flange portion. Hinges with corners can be used provided that the hinge size is large enough to allow a boot to be installed without damaging a flange. In one example, the hinge size is approximately 17/64 of an inch in diameter. Hinge size may vary based on the shape of the hinge, the type of material used to manufacture the boot, and the expected variation from pier to pier in the same size and shape family. In an example boot, constructed from 1/16" corrugated vinyl with round hinges to prevent lateral tearing into the flange portion during installation, 17/64 of an inch was chosen to allow for the typical maximum size variation of a 12"×12" square masonry support pier, which is up to ½ of an inch on any one side.

The polymer material that makes up a pier boot can be any material flexible enough to allow a flap to open perpendicularly to the flange and strong enough to allow the hinge to open without tearing into the flange. The gauge of the material may vary depending on the characteristics of the material. Vinyl is used in the present example, because it is durable and easy to handle. Other polymers such as polyethylene, polyester, polypropylene, or other substantially impermeable material may be used.

In use, the pier boot is most advantageously mounted around a pier during construction. In this way, a pier boot may be mounted around a pier without cutting or otherwise damaging the pier boot. However, it is possible to install a pier boot around an existing pier in a finished structure. In this case, the pier boot would need to be cut through on at least one flange and then resealed along that cut line. FIG. 1 illustrates an installer 14 mounting pier boot 10 around a pier 12 during construction—before any supports or other beams are mounted onto the top of the pier. The flaps 22 are sealed to the pier 12 by applying adhesive to the flaps and/or the side of the pier. A floor poly film (not shown) is subsequently sealed to the flange portion 20 of the pier boot 10.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A pier boot for installation around a pier in the crawlspace of a building, the pier boot comprising:

a substantially impermeable polymer sheet;

wherein the polymer sheet comprises a flange portion and a plurality of slits therein;

further wherein the slits define flap portions of the polymer sheet and the slits each have an end that defines a hinge in the polymer sheet, and wherein the slits are contained completely within the polymer sheet such that the polymer sheet is seamless.

2. A pier boot as described in claim 1, wherein the plurality of slits comprise two intersecting slits in the polymer sheet.

3. A pier boot as described in claim 2, wherein the two slits are substantially straight lines that intersect approximately at midpoints in a length of the two slits, whereby the two slits form an "x" in the polymer sheet.

4. A pier boot as described in claim 1, wherein the slits are open on one end to a side of the polymer sheet.

5. A pier boot as described in claim 1, wherein the hinge shape is round.

6. A method of creating a vapor barrier around a building pier comprising the steps of:

providing a pier;

providing a pier boot comprising:

a substantially impermeable polymer sheet;

wherein the polymer sheet comprises a flange portion and a plurality of slits therein;

further wherein the slits define flap portions of the polymer sheet and the slits each have an end that defines a hinge in the polymer sheet;

mounting the pier boot around the pier wherein the flaps rest against a side of the pier and the flange portion rests againstthe ground; and applying adhesive to the flaps and/or pier and sealing the flaps to the pier.

7. A method of creating a vapor barrier around a building pier as described in claim 6, wherein the building pier is substantially rectangular in horizontal cross section; and the mounting step includes substantially aligning corners of the pier adjacent hinges in the polymer sheet.

8. A method of creating a vapor barrier around a building pier as described in claim 6, wherein the plurality of slits comprise two intersecting slits in the polymer sheet, and the two slits are substantially straight lines that intersect approximately at midpoints in a length of the two slits, whereby the two slits form an "x" in the polymer sheet; and the mounting step includes substantially aligning corners of the pier adjacent hinges at the end of the "x" in the polymer sheet.

* * * * *